United States Patent [19]

Crossin

[11] Patent Number: 4,661,287

[45] Date of Patent: Apr. 28, 1987

[54] STABLE SOIL RELEASE PROMOTING ENZYMATIC LIQUID DETERGENT COMPOSITION

[75] Inventor: Michael C. Crossin, Kendall Park, N.J.

[73] Assignee: Colgate-Palmolive Company, New York, N.Y.

[21] Appl. No.: 713,945

[22] Filed: Mar. 19, 1985

Related U.S. Application Data

[63] Continuation-in-part of Ser. No. 539,079, Oct. 5, 1983, abandoned, and Ser. No. 539,080, Oct. 5, 1983, abandoned, and Ser. No. 628,697, Jul. 11, 1984, abandoned, said Ser. No. 539,079, and Ser. No. 539,080, is a continuation-in-part of Ser. No. 481,904, Apr. 4, 1983, abandoned.

[51] Int. Cl.[4] ..... C11D 1/83; C11D 3/37; C11D 3/28

[52] U.S. Cl. ..... 252/542; 252/174.12; 252/174.23; 252/550; 252/551; 252/554; 252/555; 252/559; 252/DIG. 2; 252/DIG. 14

[58] Field of Search ..... 252/174.12, 174.23, 252/559, DIG. 2, DIG. 15, 542

[56] References Cited

U.S. PATENT DOCUMENTS

| | | | |
|---|---|---|---|
| 4,116,885 | 9/1978 | Derstadt et al. | 252/532 |
| 4,125,370 | 11/1978 | Nicol | 8/137.5 |
| 4,132,680 | 1/1979 | Nicol | 252/547 |
| 4,287,082 | 9/1981 | Tolfo et al. | 252/174.12 |
| 4,305,837 | 12/1981 | Kaminsky et al. | 252/174.12 |
| 4,318,818 | 3/1982 | Letton et al. | 252/174.12 |
| 4,368,147 | 1/1983 | Inamorato et al. | 252/545 |
| 4,411,831 | 10/1983 | Robinson et al. | 252/554 |

OTHER PUBLICATIONS

"Quaker QCF", Technical Data, Quaker Chemical Corp., Conshohocken, Pa., (Al Karil QCF), pp. 1 & 2.

*Primary Examiner*—Prince E. Willis

*Attorney, Agent, or Firm*—Herbert S. Sylvester; Murray M. Grill; Norman Blumenkopf

[57] ABSTRACT

A stable soil release promoting enzymatic primarily nonionic liquid detergent composition comprises a synthetic organic nonionic detergent, an anionic sulf(on-)ated synthetic organic detergent, a particular type of soil release promoting copolymer of polyethylene terephthalate (PET) and polyoxyethylene terephthalate (POET), a proportion of enzyme(s) sufficient to enzymatically hydrolyze proteinaceous and/or amylaceous soils on fabrics during washing thereof with an aqueous washing solution of the liquid detergent, a fluorescent brightener, a stabilizing proportion of a stabilizer for the enzyme(s), which also acts as a buffer for the liquid detergent composition to maintain the pH in a certain neutral or slightly acidic range to stabilize the PET - POET copolymer and the fluorescent brightener, and an aqueous medium.

The described composition is non-separating and is chemically stable on storage. It substantially retains its soil hydrolyzing, fluorescent brightening and soil release promoting characteristics on storage, so that laundry washed with it is effectively cleaned, brightened, and treated. Also within the invention are processes for manufacturing the product and for utilizing it to wash laundry.

4 Claims, No Drawings

STABLE SOIL RELEASE PROMOTING ENZYMATIC LIQUID DETERGENT COMPOSITION

This application is a continuation-in-part of my previously filed applications Ser. Nos. 539,079, 539,080 both filed 10-5-83 and 628,967, filed 7-11-84 of which Ser. Nos. 539,079 and 539,080 are continuations-in-part of Ser. No. 481,904 filed 4-4-83. All such applications have been abandoned.

This invention relates to stable liquid detergent compositions. More particularly, it relates to such compositions which contain effective proportions of several detersive components and which contain a stabilized soil release promoting polymer which deposits on polyester and polyester blend materials during washing thereof and promotes the release from them of subsequently applied lipophilic soils. Such compositions also contain enzyme(s) and fluorescent brightener(s), for their known properties, and surprisingly, the compositions are physically and functionally stable upon storage despite the fact that other liquid detergent compositions containing some such components have been found to be unstable.

This application is directed to what is referred to as a "½ cup" product, meaning that ½ cup thereof is the normal charge to a home washing machine that contains a normal wash load (about 3.5 kg.) of laundry in about 65 liters of wash water. Previously I had filed other applications for patent: Ser. Nos. 481,904 (now abandoned); 539,079; 539,080; and 628,967, all of which were directed to liquid detergent compositions of the "¼ cup" type. Such other applications were for more concentrated formulations and sometimes included other materials in addition to those of the present invention, and therefore different limitations were imposed in such applications to produce acceptable products. Ser. No. 539,079 has been replaced by continuation application Ser. No. 821,574 and Ser. No. 539,080 has been replaced by continuation applicaton Ser. No. 821,572, both of which were filed on Jan. 21, 1986.

Liquid detergents have been employed for the washing of household laundry items in washing machines, and various such detergents have contained enzymes (although often much or all of the enzymatic activity was lost on storage). The employment of copolymers of polyethylene terephthalate and polyoxyethylene terephthalate in detergent compositions as soil release promoting agents has been described in various patents, among which may be mentioned British Pat. Nos. 1,154,370 and 1,377,092, and U.S. Pat. Nos. 3,962,152, 4,125,370 and 4,132,680. Liquid detergents containing the mentioned type of soil release promoting polymer are described in U.S. Pat. Nos. 4,125,370 and 4,132,680. In both such patents, however, the liquid detergents described are not of the type of the present invention because those of the patents contain triethanolamine and/or ionizable water soluble salts in such proportions that they would tend to destabilize liquid detergents containing as a soil release promoting agent a copolymer of the present invented compositions and/or destabilize such soil release promoting polymer on storage, causing the polymer to separate from the other components and/or making it less effective for promoting soil release.

In liquid detergents enzymes tend to lose activity on storage unless stabilized, as by certain salts, e.g., sodium formate. However, the mentioned salts tend to destabilize the copolymer soil release promoting agent, which is a desirable component of the present liquid detergents, and such destabilization of the soil release promoting agent is especially severe in the presence of lower alkanolamine or salts thereof, such as triethanolamine (TEA), and multivalent salts, such as $K_2SO_4$, the presences of which should be avoided, according to the present invention. Additionally, certain anionic detergents, such as sodium higher alkyl benzene sulfonates, can sometimes have destabilizing effects on the soil release promoting polymers and on the enzyme of the present compositions. Therefore it was surprising that the present liquid detergent could be made in stable nonseparating form, with the various functional components thereof still being effective after storage at elevated temperatures.

In accordance with the present invention a stable soil release promoting enzymatic liquid detergent (of the ½ cup type) comprises a detersive proportion of a nonionic detergent, a detergent supplementing and fluorescent brightener substantivity increasing proportion of an anionic sulf(on)ated synthetic organic detergent, a fluorescent brightening proportion of a fluorescent brightener, a soil release promoting proportion of a soil release promoting polymer of polyethylene terephthalate and polyoxyethylene terephthalate, a proportion of enzyme sufficient to enzymatically hydrolyze proteinaceous and/or amylaceous soils on fabrics during washing thereof with an aqueous washing solution of such liquid detergent composition, a stabilizing and buffering proportion of a stabilizer for the enzyme(s), which also acts to maintain the downside pH on storage no lower than 6.2,and an aqueous medium, in which the pH is in the range of 6.2 to 6.5 after storage, in which the viscosity is maintained in the range of 50 to 150 centipoises, and in which there is present no triethanolamine or less than 0.2% thereof, and no more than a total of 10% of water soluble ionizable salt material (including ionizable detergent). In some formuations within this invention the pH (on storage) may decrease to a value in the range of 5.8 to 7.0 without destabilizing the copolymer, the enzyme(s) or the fluorescent brightener, depending in part on which of such components are present. However, it is preferred that it be in the 6.2 to 7.0 range and it is highly preferred that such pH be in the 6.2 to 6.5 range. Ideally, it should be as close to 6.2 as possible without causing any precipitation of any liquid detergent constituent, such as the brightener.

Although various synthetic organic nonionic detergents of satisfactory physical characteristics may be utilized, including condensation products of ethylene oxide and propylene oxide with each other and with hydroxyl-containing bases, such as nonyl phenol and Oxo-type alcohols, for best results it is highly preferred that the nonionic detergent be a condensation product of ethylene oxide and higher linear or fatty alcohol. In such products the higher alcohol is of 10 to 20 carbon atoms, preferably 12 to 15 or 16 carbon atoms, and the nonionic detergent contains from 2 to 30 ethylene oxide groups per mole, preferably 3 to 20, and more preferably 6 to 11 or 12. Most preferably, the nonionic detergent will be one in which the higher alcohol is of about 12 to 15 or 12 to 14 carbon atoms and which contains from 6 to 11 or 7 to 11 moles of ethylene oxide, e.g., 6.5 or 7. Among such detergents are Alfonic® 1214-60C, sold by the Conoco Division of E. I. DuPont de Nemours & Co., Inc., and Neodols® 23-6.5 and 25-7, available from Shell Chemical Company. Among their especially attractive properties, in addition to good detergency with respect to oily and greasy soil deposits on goods to be washed, and excellent compatibility with the present polymeric release agents and enzymes, are compatibilities with the various other components of the present liquid detergent compositions and long term viscosity stability in aqueous and aqueous alcoholic solutions.

The anionic detergent component of the invented liquid detergent compositions is a sulfated or sulfonated synthetic organic detergent. For simplicity such "sulfated and/or sulfonated" detergents are designated "sulf(on)ated". The useful sulf(on)ated detergents include the linear higher alkylbenzene sulfonates, olefin sulfonates and paraffin sulfonates, and higher fatty alcohol sulfates, higher fatty alcohol polyethoxylate sulfates (of 3 to 30 ethoxy groups, preferably 3 to 15), monoglyceride sulfates, and other acceptable and commercially available sulf(on)ates of satisfactory detersive properties and stabilities in the present liquid detergent compositions. Such products will normally contain a lipophilic moiety which includes a higher aliphatic group, of which groups the most preferred is higher linear alkyl. Such alkyl will normally be of 8 to 20 carbon atoms, preferably being of 10 to 18 carbon atoms, e.g., lauryl, myristyl, cetyl. While it is often preferred to utilize alkyls derived from natural fats and oils, synthetic products are also useful and often are interchangeable with those derived from natural sources. In some instances branched alkyls are useful but normally those which are linear or substantially linear will be preferred. It is a feature of this invention that although the mentioned detergent salts may be of ammonia or of certain alkanolamines to promote solubility in the aqueous medium, alkali metal salts, preferably sodium salts, are sufficiently soluble in such media in the present formulations so as to make clear products which are stable on storage and maintain their attractive clear appearances, as well as their functional activities.

The soil release promoting polymer is a polymer of polyethylene terephthalate and polyoxyethylene terephthalate which is soluble in these compositions and is depositable from wash water containing the detergent(s) onto synthetic organic polymeric fibrous materials, especially polyesters and polyester blends, so as to impart soil release properties to them, while maintaining them comfortable to a wearer of clothing made from such materials, and not preventing or significantly inhibiting vapor transmission through such clothing. Such polyesters have also been found to possess antiredeposition properties and often assist in removing stains from substrates. They tend to maintain soil, especially oily or greasy soils, dispersed in wash water during washing and rinsing, so that it is not redeposited on the laundry. Useful such products are copolymers of ethylene glycol or other suitable source of ethylene oxide moiety, polyoxyethylene glycol and terephthalic acid or suitable source of the terephthalate moiety. The copolymers may also be considered to be condensation products of polyethylene terephthalate (PET), which may sometimes be referred to as an ethylene terephthalate polymer, and polyoxyethylene terephthalate (POET). While the terephthalic moiety is preferred as the sole dibasic acid moiety in the polymer it is within the invention to utilize a relatively small proportion of isophthalic acid and/or orthophthalic acid (and sometimes other dibasic acids, too) to modify the properties of the polymer. However, the proportions of such acids or sources of such supplemental moieties charged to any reaction mix, and the corresponding proportions in the final polymer, will normally be less than 10% each of the total phthalic moieties present, and preferably will be less than 5% thereof.

The molecular weight of the polymer will be in the range of about 15,000 to 50,000, preferably being about 19,000 or 20,000 to 43,000, more preferably being about 19,000 to 25,000, e.g., about 22,000. Such molecular weights are weight average molecular weights, as distinguished from number average molecular weights, which, in the case of the present polymers, are often lower. In the polymers utilized the polyoxyethylene will be of a molecular weight in the range of about 1,000 to 10,000, preferably about 2,500 to 5,000, more preferably 3,000 to 4,000, e.g., about 3,400. In such polymers the molar ratio of polyethylene terephthalate to polyoxyethylene terephthalate units (considering

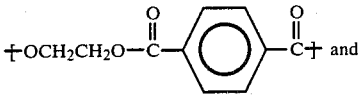

and

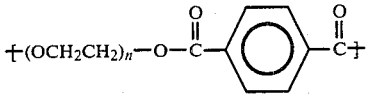

as such units) will be within the range of 2:1 to 6:1, preferably 5:2 to 5:1, even more preferably 3:1 to 4:1, e.g., about 3:1. The proportion of othylene oxide to phthalic moiety in the polymer will be at least 10:1 and often will be 20:1 or more, preferably being within the range of 20:1 to 30:1 or more, more preferably being about 22:1. Thus, it is seen that the polymer may be considered as being essentially a modified ethylene oxide polymer, with the phthalic moiety being only a relatively minor component thereof, whether calculated on a molar or weight basis. It is considered surprising that, with such a comparatively small proportion of ethylene terephthalate or polyethylene terephthalate in the polymer, the polymer is sufficiently similar to the polymer of the polyester fiber substrate (or other polymers to which it may be adherent, such as polyamides) that it is retained thereon during the washing, rinsing and drying operations. Yet, as shown by comparative experiments and various washing tests in which soil release is measured, the described polymer, in the present detergent compositions, deposits on washed synthetics, especially polyesters, from the wash water, so as to make the synthetics better able to be washed free of oily soil by subsequent washing with the liquid nonionic detergent composition or other detergent product. It is considered that the polymer's hydrophilic properties, attributable to the large proportion of hydrophilic ethylene oxide moieties therein, may be responsible for the excellent soil release properties (for releasing lipophilic soils) which it imparts to the materials upon which it is deposited. Such hydrophilicity may also help the polymer to coact with the liquid nonionic detergent product components and may help to stabilize the polymer in the presence of the other liquid detergent components of this invention. Yet, compared to other PET - POET copolymers, that of the present invention may often be more effective as a soil release promoter because it contains a balance of lipophilic groups, sufficient to make it adherent or substantiive to polyester fibers.

Various literature articles, texts and patents disclose methods for the manufacture of the present type of polymers, included among which are: *Journal of Polymer Science*, Vol. 3, pages 609–630 (1948); *Journal of Polymer Science*, Vol. 8, pages 1–22 (1951); *Fibers From Synthetic Polymers*, by Hill, published by Elsevier Publising Company, New York, N.Y. (1953), at pages 320–322; British Pat. Nos. 1,088,984 and 1,119,367; and U.S. Pat. Nos. 3,557,039; 3,893,929; and 3,959,230. Although suitable methods which are adaptable for making the instant polymers are described in such references it is considered that none of them discloses the particular polymers which are utilized in the present invention (but such are available commercially) and none of them discloses the present detergent compositions. Such polymers may be considered as having been randomly constructed from polyethylene terephthalate and polyoxyethylene terephthalate moieties, such as may be obtained by reacting polyethylene terephthalate (e.g., spinning grade) and polyoxyethylene terephthalate, or reacting the ethylene glycol, polyoxyethylene glycol and acid or methyl ester precursors thereof. Yet, it is also within the invention to utilize more ordered copolymers, such as those made by reacting components of predetermined or known chain lengths or molecular weights, so as to produce what might be referred to as block copolymers or non-random copolymers. Graft polymers may also be practicable.

Useful copolymers for the manufacture of the detergent compositions of this invention are marketed by Alkaril Chemicals, Inc., and commercial products of such company that have been successfully employed to produce satisfactory soil release promoting detergent compositions are those sold by them under the trademarks Alkaril QCJ and Alkaril QCF, formerly Quaker QCJ and Quaker QCF (Alkaril Chemicals, Inc. acquired Quaker Chemical Corporation). Such are described in an undated two-page Quaker Chemical Corporation Technical Data Sheet, entitled Quaker QCF. The QCJ product, normally supplied as an aqueous dispersion, of about 15% concentration in water, and preferably used to make the present liquid detergents, is also available as an essentially dry solid (QCF). In both such types of products the molar ratio of ethylene oxide to phthalic moiety is about 22:1. In a 16% dispersion in water, as QCJ, the viscosity at 100° C., is about 96 centistokes. The higher the molecular weight of the polymer the lower the hydrophile:hydrophobe molar ratio may be therein and still result in satisfactory soil release promoting by the invented detergent compositions. The QCJ and QCF polymers have melting points (by differential thermal analysis) of about 50° to 60° C., a carboxyl analysis of 5 to 20 equivalents $/10^6$ grams and a pH of 6 to 8 in distilled water at 5% concentration. The molecular weight (weight average) is in the range of 20,000 to 25,000 and the ethylene terephthalate:polyoxyethylene terephthalate units molar ratio is about 74:26. The mentioned trademarked products are soluble in water or hot water (at 40° to 70° C.) or at least are readily dispersible, and may be characterized as of high molecular weight, over 15,000, generally in the range of 19,000 to 43,000, often preferably 20,000 to 25,000, e.g., about 22,000.

The enzymes employed include both proteolytic and amylolytic enzymes, such as the alkaline proteases (subtilisin) and alpha-amylase. Among preferred enzyme preparations that are useful are Alcalase 2.5 L (2.5 Anson units/g.) and Termamyl 120 L, both manufactured by Novo Industri, A/S. However, other suitable proteolytic and amylolytic enzyme preparations may be used, too. The mentioned compositions are in liquid form and contain 5% of active enzyme in combination with 65% of propylene glycol and 30% of water. In this specification proportions referred to are of the enzymes in the preparations, the active parts thereof.

The stabilizer or a mixture of stabilizers for the enzyme is most preferably sodium formate or includes such salt, but other water soluble carboxylates, such as potassium formate and acetates, can also be employed, with the proportion present being such as to keep the final equilibrium pH no less than 5.8, preferably not less than 6.1, and more preferably not less than 6.2, and equivalent salts or mixtures of such salts may be used. Acetates, sometimes used with calcium ion, e.g., at about 100–200 p.p.m., are effective stabilizers for the enzymes but may emit objectionable acetic or vinegary odors, and so are often avoided.

The aqueous medium employed includes water and preferably also includes a lower alkanol. The water is desirably deionized water but city water of a hardness content up to about 300 p.p.m., as calcium carbonate (the hardness is usually of mixed magnesium and calcium ions), may often be employed, although it is preferable for the water to be softened (as by zeolite treatment) and for the hardness content to be less than 50 p.p.m., and preferably less than 20 p.p.m., to help to avoid objectionable cloudiness or destabilization of the liquid detergent, or separations of any components thereof. Instead of deionized or softened water some water may be from the starting materials, such as aqueous soil release promoters, enzyme preparations, alkanols, and dyes. The lower alkanol (used as a co-solvent) may be ethanol, isopropanol or n-propanol, but ethanol is much preferred. When ethanol is employed it will normally be as a denatured alcohol, such as SD-3A or SD-40-2, which include a small proportion of water plus denaturant. Small amounts of compatible dissolved salts may also be present in the aqueous medium but normally such will be avoided to the extent feasible.

Various suitable adjuvants may be present in the invented liquid detergents, such as fluorescent dyes, colorants (dyes and water dispersible pigments, such as ultramarine blue), bactericides, fungicides and perfumes. Concentrations of such components will usually be kept low, often less than 1% and preferably less than 0.7%. Thus, the perfume concentration will be less than 1%, preferably 0.2 to 0.6%, e.g., 0.4%. Fluorescent brighteners or optical bleach compounds may be present in the liquid detergent to an extent of 0.02 to 2%, preferably 0.05 to 0.5% and more preferably 0.1 to 0.3 or 0.4%, e.g., 0.2%. The percentages given are of the commercially supplied materials. Such brighteners are known as cotton brighteners, bleach soluble brighteners, polyamide brighteners and polyester brighteners, and generally mixtures thereof are employed so as to make the detergent useful for brightening a wide variety of materials being washed, including cotton and synthetics. Exemplary of such good brighteners are those identified as: TA; DM; DMEA; DDEA; DMDDEA; BA; NTA; BBI; AC; DP; BBO; BOS; and NTSA, in a well known article entitled *Optical Brighteners and Their Evaluation* by Per S. Stensby, published in *Soap and Chemical Specialties* in April, May, July, August and September, 1967. Further discussions of the fluorescent brighteners may be found in an article entitled *Optical Bleaches in the Soaps and Detergents* by F. G. Villaume, appearing in *The Journal of the American Oil Chemists' Society* (October 1958), Vol. 35, No. 10, pp. 558–566. Useful fluores-cent brighteners are sold under the trade names: Phorwite RKH ( Mobay); Phorwite BHC ( Mobay ); Calcofluor White ALF (American Cyanamid); ALF-N (American Cyanamid); SOF A-2001 (CIBA); CWD (Hilton-Davis); CSL, powder, acid (American Cyanamid); FB 766 ( Mobay); Blancophor PD(GAF); UNPA (Geigy); Tinopal RBS (Geigy); and Tinopal RBS 200 (Geigy). The various brighteners are normally present as their water soluble salts but may also be employed in the corresponding acid forms. Most such materials are useful for brightening cotton and are of the stilbene sulfonic acid (or salt) or aminostilbene types, herein referred to as stilbene brighteners. Colorants, such as Polar Brilliant Blue, will be from 0.001 to 0.03%, preferably 0.002 to 0.02% of the liquid detergent, e.g., 0.01%, if present. The various adjuvant materials will be chosen for a compatibility with the other formula components and for non-separating and non-settling characteristics. Because water soluble ionizable salts, whether inorganic or organic, are generally incompatible with soil release promoting agents, especially if the salts are multivalent (including bivalent) their presence will usually be avoided to the extent possible. However, the anionic detergent, sodium formate and sodium acetate are ionizable salts which can be tolerated by the present compositions and so the upper limit for such salt content can be as high as 10%. Usually such a limit for multivalent salt content should be set at about 2%, preferably at 1%. Among the salts that are desirably avoided are sodium sulfate, potassium sulfate, ammonium sulfate, sodium chloride, potassium chloride and ammonium chloride and especially the sulfates, but these are only some examples of such salts. The presences of ionizable species, such as triethanolamine (TEA), diethanolamine, ethanolamine, diisopropanolamine, n-propanolamine and of the lower mono-, di-, tri- and mixed lower alkanolamines of 2 to 4 carbon atoms per alkanol moiety will be avoided because, like the mentioned salts, they can destabilize the soil release promoting polymer and/or the liquid detergent. Of these, TEA appears to be the most destabilizing, causing severe separations of the polymer. In this specification such ionizable species, which may form salts, should be counted as parts of the permissible proportions of any such salts that may be present. Generally it will be desirable to avoid the presences of other adjuvants than colorants, perfumes, fluorescent brighteners, anti-oxidants and any neutralizing agents that may be employed to adjust the pH of the liquid detergent to the stable range. It is preferred that any pH adjusting agent which may be employed, to increase or decrease the pH of the liquid detergent mixture, should be an alkali metal hydroxide, such as sodium hydroxide, in aqueous solution at a concentration of from 5 to 40%, e.g., 15 to 25%, or an acid, such as sulfuric acid, at a concentration of from 75 to 95%, e.g., 93.7%. Especially to be avoided, even in proportions as little as 0.1%, are triethanolamine salts and free triethanolamine.

The liquid detergent, as made, will be of a desirable viscosity, usually in the range of 50 to 150 or 200 centipoises, preferably 65 to 115 centipoises, e.g., 90 cps. The viscosity may be adjusted by modifying the proportion of lower alkanol, within the range given. The liquid detergent will be readily pourable but will possess a desired "body". The making pH, that at which the product is manufactured and to which it may then be adjusted (but it will drift downwardly to as close to 6.2 as possible, on storage), will be in the range of 7.3 to 7.8, e.g., 7.7. However, the eventual equilibrium pH will be as close to 6.2 as possible to maximize QCJ polymer stability and still not cause the fluorescent brightener to fall out of solution on storage. The equilibrium pH will be reached after a month's storage or less. At least by that time the pH will have decreased into the 6.2 to 7.0 range, and usually will be about 6.2.

In the invented soil release promoting liquid detergents of this invention, which are of improved clarity and stability on storage, so that the soil release promoting polymer and enzyme(s) do not objectionably cloud or deteriorate and do not separate from the rest of the composition, the proportions of the various components will be as are given below. All the various components recited, although stated in the singular, include mixtures too. The synthetic organic nonionic detergent content will normally be within the range of 10 to 22% of the product, preferably being 12 to 20% and more preferably 15 to 17%, e.g., 16%. The anionic detergent content will usually be 2 to 6%, preferably 3 to 5% and more preferably 3 to 4%, e.g., 3.5%. The fluorescent brightener content is in the range of 0.05 to 0.5% and preferably is 0.1 to 0.4% or 0.1 to 0.3%, e.g., 0.2%. The soil release promoting polymer content will be about 0.4 to 2%, preferably 0.5 to 1.5%, and more preferably 0.8 to 1.2%, e.g., about 1% (active ingredient basis). The total enzyme content (pure basis) will usually be in the range from 0.02 to 0.1%, preferably 0.025 to 0.05%, and more preferably about 0.04%. Normally at least half of the enzyme will be proteolytic and preferably about 60% will be proteolytic and about 40% will be amylolytic. The stabilizer for the enzyme, an alkali metal salt of a lower aliphatic acid of 1 to 3 carbon atoms, very preferably sodium formate, will usually be from 0.2 to 5%, preferably, for sodium formate, 2 to 4%, and more preferably about 3%, and preferably, for sodium acetate, 0.2 to 1% and more preferably about 0.5%. The lower alkanol content will be from 2 to 10%, preferably 3 to 8% and more preferably 4 to 6%, e.g., about 5%. The water content will be about 55 to 75%, preferably 65 to 75%, more preferably 70 to 75%, e.g., about 70%. The aqueous medium (the water and the alkanol) is the balance of the liquid detergent, usually being 60 to 85%, preferably 65 to 80% and more preferably 70 to 80% thereof, with 5 to 25% of the medium being lower alkanol, preferably 5 to 15% and more preferably about 7%, and with the balance being water.

The described liquid detergent composition is clear, as made, and can retain its clarity over long periods of storage. The PET - POET copolymer, which often tends to deteriorate in liquid detergent compositions on storage, causing them to become cloudy in appearance, and decreasing the soil release promoting activity of the copolymer, especially in the presence of triethanolamine and ionizable salts, maintains its stability in the present compositions despite the presence therein of such ionizable salts, apparently because the salts that are present, sodium formate (and/or acetate) and sodium linear higher alkylbenzene sulfonate, in combination with the other components of the liquid detergent composition, are prevented from adversely affecting the copolymer when the pH is maintained in the 6.2 to 7.0 range on storage, and best results are obtained at storage at a pH of about 6.2, at which the fluorescent brightener remains soluble, the QCF is stable and the enzymes retain their activities.

The sodium formate, when employed, stabilizes the enzyme(s) and prevents such from deteriorating during storage, which could cause clouding of the liquid detergent composition, while decreasing detergency. The sodium formate (or acetate) also acts as a effective buffer for the liquid detergent composition, preferably buffering the pH at 6.2 and preventing deterioration of the copolymer, and preventing the fluorescent brightener from dropping out of the solution. It is surprising that the sodium formate, which is a known stabilizer for enzymes, also acts as an effective buffering agent in the present system. Such is suprising because the $K_a$ of odium formate is about 4.5, which would lead one to expect it to be a poor buffer for the pH range of 6 to 7. However, experience has shown that it satisfactorily buffers the particular described system against objectionable pH changes, which could otherwise occur initially primarily due to the reaction of carbon dioxide, liquid detergent bottle head space and air, with the minor alkalinity of the detergent. Thus, by means of the present invention a single material, sodium formate (or other suitable lower carboxylate), performs two functions in the liquid detergent, stabilizing the enzyme and buffering the detergent, thereby preventing deterioration of the copolymer and the enzyme, and preventing precipitation out, on storage, of the copolymer and fluorescent brightener. Such effects are unpredictable and are unexpectedly beneficial.

The invented liquid detergents may be made by mixing the various components thereof (except for the enzyme) with the aqueous medium, preferably containing at least some of the lower alkanol, until they dissolve or almost dissolve therein, or different components (except the enzyme) may be selectively dissolved in portions of the water and/or lower alkanol and/or liquid soil release promoting polymer preparation, etc., and then the various liquid fractions may be mixed together. After such mixing the pH will be measured and if it is out of the correct intial or making range it will be adjusted with either sodium hydroxide solution or sulfuric acid solution (or both) unitl it is in the range of 7.3 to 8.1, preferably 7.5 to 7.9, more preferably 7.6 to 7.8, e.g., 7.7. Despite the fact that the pH adjusting materials can form ionizable salts when such salts are not multivalent they do not have as much effect in causing the product to become unstable so long as the proportion of total salt present (including anionic detergent and enzyme stabilizer) does not exceed 10%, preferably being less than 8% and most preferably being less than 7%. On the other hand, the limit on content of multivalent salt content should be set at about 2% and will preferably be 1% and more preferably ½%, e.g., 0.2%. The preferred alkaline pH increasing agent is an aqueous solution of sodium hydroxide, which will normally be between 10 and 45% sodium hydroxide, preferably 20 to 41%, although more dilute concentrations may sometimes be desirable. The preferred acidic pH adjusting agent is a fairly concentrated aqueous sulfuric acid of 75 to 95% concentration, preferably 93.2% (66° Be.). Preferably the pH adjusting agents will be rather concentrated to avoid diluting the liquid detergent, and preferably the amounts added will be minimized to limit the salt content produced. Conjointly the viscosity of the product may be adjusted by means of alkanol and/or water addition.

The invented liquid detergent composition may be used to wash (and treat) laundry containing synthetic fibers, such as those of polyester, e.g., Dacron ®, in the normal manner used in washing with other "½ cup" liquid detergents. The concentration of the liquid detergent used will normally be from about 0.04 to 0.6%, preferably being 0.1 to 0.3%. Generally, it will be advised to use about ½ cup (about 120 ml.) of the liquid detergent per standard wash load (about 17 U.S. gallons or 65 liters for a top loading washing machine), which is a concentration of about 0.19% of the liquid detergent in the wash water. About the same concentration may be used when washing is in a front loading machine, although the water employed is less. Normally about 7 or 8 pounds (3 to 3.5 kg.), of laundry will be charged to the washing machine. The wash water will preferably be at least 120° F. (49° C.) but good washing and treatments, with the soil release promoting polymer, the enzymes and the fluorescent brightener in the liquid detergent, are obtainable at temperatures in the range of about 40° to 80° C., preferably 45° to 70° C. The dry weight of materials being washed and treated will usually be from about 3 to 10% or 4 to 8% of the weight of the aqueous washing medium, preferably about 4 to 6% thereof. The wash will be conducted with agitation over a period of about five minutes to one-half hour or one hour, often from 10 to 20 minutes. Then the washing materials will be rinsed, usually with several rinses, and will be dried, as in an automatic laundry dryer. Preferably, the first washing of the material to be treated will be when that material is not unduly dirty, so that the soil release promoting polymer will be deposited on as clean a surface as possible. However, this is not necessary, and improvements in the cleaning of subsequently soiled materials and swatches will be observed when no special effort is made to have the first washing be that of a cleaner substrate. Up to a limit, sometimes about three or five treatments, plural washings with the liquid detergent of this ivention increase the soil releasing properties of the treated material, while maintaining its normal feel and appearance. However, while more than five launderings may not keep increasing soil release, the level of soil release promoting action is maintained and further repeated washings with the described liquid detergent result in good cleaning and soil release.

When polyester and polyester/cotton blend fabrics are washed in the manner described, with the compositions of this invention, and are then soiled or spotted with dirty motor oil and washed with a detergent of this invention or another commercial detergent (often of the built type), significant removal of the lipophilic soil is noted, compared to similar treatments in which the liquid detergent initially employed did not contain any soil release promoting polymer. In other comparisons, when substantial proportions of water soluble multivalent ionizable salt, such as more than 2% of sodium sulfate, or more than 1% of triethanolamine or a salt thereof, is present in the liquid detergent it is found that after storage at elevated temperature (43° C.) for two weeks, simulating a lengthier storage at rrom temperature, phases separate from the liquid detergent body and the soil release promoting properties of the polymer contained therein are diminished, as are the enzymatic, brightening and detersive activities. It is normally preferred to omit the triethanolamine or, if it is present, to limit it to 0.2% of the product. When the enzyme stabilizer is omitted enzymatic action is decreased substantially on storage, and the clear liquid detergent turns cloudy, due to the pH not being maintained at the required level. Thus, the compositions of this invention are useful and unexpectedly beneficial. They are stable, resulting in a more effective product for the purposes intended, detergency, soil release promoting, fluorescent brightening and enzymatic cleaning effects, and also resulting in a more attractive liquid detergent composition, which does not separate on storage.

The following examples illustrate the invention but do not limit it. Unless otherwise indicated, all parts are by weight and all temperatures are in °C.

EXAMPLE 1

| Component | Percent |
|---|---|
| Neodol 25-7[1] | 16.1 |
| Sodium linear dodecylbenzene sulfonate solution[2] | 6.71 |
| Alkaril QCJ[3] soil release promoting polymer | 6.7 |
| Denatured ethanol (3A, 90.5% ethanol, by volume) | 5.5 |
| Sodium formate, technical grade (96% active, minimum) | 3.0 |
| Dual enzyme (liquid)[4] | 0.75 |
| Phorwite RKH (pure)[5] | 0.13 |
| Phorwite BHC[6] 766 | 0.08 |
| Dye (Polar Brilliant Blue, 1% aqueous solution) | 1.0 |
| Perfume | 0.4 |
| Softened water[7] | 59.6 |
| | 100.0 |

[1]Condensation product of approximately 7 moles of ethylene oxide and a higher fatty alcohol averaging 12 to 15 carbon atoms per mole, sold by Shell Chemical Co.
[2]52.2% Active ingredient aqueous solution
[3]15% Solution or dispersion in water of a copolymer of polyethylene terephthalate and polyoxyethylene terephthalate of a molecular weight of about 22,000 wherein the polyoxyethylene is of a molecular weight of about 3,400, the molar ratio of polyethylene terephthalate to polyoxyethylene terephthalate units is about 3:1 and the proportion of ethylene oxide to phthalic moiety in the polymer is about 22:1, sold by Alkaril Chemicals, Inc.
[4]60% of Proteolytic enzyme, Alcalase 2.5L, sold by Novo Industri, A/S (5% enzyme active ingredient, 65% propylene glycol and 30% water) and 40% of amylolytic enzyme, Termamyl 120L, sold by Novo Industri, A/S (5% enzyme A.I., 65% propylene glycol and 30% water)
[5]A stilbene-type fluorescent brightener, 4,4'-bis(4-anilino-6-methylamino-s-triazin-2-ylamino)-2,2'-stilbene-disulfonic acid sold by CIBA-GEIGY
[6]A stilbene-type fluorescent brightener, 4-4'bis(4-phenyl-2H—1,2,3-triazolyl-2-yl)-2,2'-stilbene dipotassium sulfonate, sold by CIBA-GEIGY
[7]Zeolite-softened water, of a hardness, as $CaCO_3$, less than 20 p.p.m. (normally less than 1 gram per gallon)

The formula liquid detergent is made by mixing together, in order, part (most) of the water, followed by the alcohol, fluorescent brightener, anionic detergent, sodium formate, nonionic detergent, dye solution, the balance of the water, and the copolymer. Mixing is continued for an additional three minutes and the pH is measured. If it is outside the desired initial range of 7.3 to 8.1 either sulfuric acid (66° Be.) or sodium hydroxide solution (40.5%, in water) is added to adjust it to 7.7. The proportion of pH adjusting material employed is small, e.g., about 0.2% or less of NaOH, or of $H_2SO_4$. Next the enzyme preparation is mixed in for three minutes and the product is filtered, to produce a sparkling transparent blue liquid composition. The product viscosity, taken at 25° C. with a Brookfield viscometer, using a No. 1 spindle, at 20 r.p.m., is 90 centipoises. The product made is tested by being stored at 43.3° C. for a week, after which it is observed to be a slightly turbid light blue liquid in a stable single phase, essentially like that when it was made. The protease activity is better than that of a control liquid detergent containing 2.8% of triethanolamine (TEA), and is much better than in other compositions like the control but containing no sodium formate. When both the formate and TEA are omitted from the control formula (in all cases the differences are made up with water) both protease and amylase activities are drastically reduced. The control and the variation thereof are unstable on storage, with the polymer settling out.

Shortly after making the liquid detergent it is used to wash a test load of clean fabrics, including some of polyester materials and others of 65% polyester and 35% cotton material. The washing concentration is 0.18% by weight of the liquid detergent, on the basis of the weight of the wash water, and the swatches washed are about 5% by weight of the wash water. After washing in a standard test washing machine, using standard conditions previously described in this specification, is completed, the swatches are rinsed and dried. Subsequently each test swatch is stained with about three drops of dirty motor oil of a standard type used for such testing and is washed in the same type of machine, using a commercial detergent. As controls, swatches that were not previously treated with the present liquid detergent are employed. The washing-treating and subsequent washing temperature are the same in all cases, being 49° C., which is considered to be an optimum temperature for treatment. In some experiments, the subsequent washing is with the invented liquid detergent composition. In all such instances the treated swatches are significantly whiter to the eye and by reflectometer testing than the control swatches, showing that the soil release promoting component of the liquid detergent composition effectively aided in the removal of such applied soil from the swatches during the subsequent washings. Also, it is noted that the redeposition onto unsoiled portions of the fabrics, of the dirty motor oil removed (from the spotting application), is diminished when soil release polymer is applied to the fabric before test soiling thereof. Thus, the present liquid detergent containing soil release promoting polymer, in addition to aiding removal of the soil, also helps to maintain it suspended, inhibiting deposition of such removed soil on other parts of the test material.

When 2.8% of triethanolamine or TEA salt is present in the liquid detergent of the formula previously given, in replacement of part of the water thereof, after storage for a week at 43.3° C. the detergent is found to have separated. Clouding and separation also occur under such conditions when the triethanolamine is absent and more than 2% of sodium sulfate is present in the formula. Storage at room temperature also results in such separation and corresponding diminution of soil release promoting activity of formulas containing the indicated proportions of triethanolamine and/or sodium sulfate, compared to the experimental formula.

When the amount of soil release promoting polymer is decreased to 0.8% of the final product the same type of results reported above are obtained, except that the 0.8% polymer formulation is slightly less effective. When the soil release polymer content is increased to 2%, while increasing the nonionic detergent content to 24% and decreasing the formate to 2% (otherwise product stability suffers), the activity of the soil release promoting polymer increases accordingly.

When similar tests are made using other lipophilic soils, such as corn oil (red), butter, shoe polish, lipstick, French dressing and barbeque sauce, similar results are obtained. The same results are also obtained when the test fabrics are single knot Dacron, double knit Dacron and Dacron/cotton blends, and such are also obtained with other treatment temperatures than 49° C. Such are also the results when instead of the laboratory testing washing machine, a commercial or home laundry machine of either top loading or side loading type is employed.

Tests of the liquid detergent for enzymatic cleaning power and fluorescent brightening are also satisfactory, indicating that the proteolytic and amylolytic enzymes are functionally effective in the stable liquid detergent, and that the fluorescent brightener did not fall out of the solution. This is so despite the fact that enzymes are often unstable in liquid detergent systems, especially at elevated temperatures, and brighteners are pH sensitive.

EXAMPLE 2

In a modification of the formula of Example 1, when the proportion of linear alkylbenzene sulfonate is dropped to 2%, on an active ingredient (A.I.) basis, the proportion of ethanol is increased to 7.5%, 0.005% of Polar Brilliant Blue dye is used (100% active) and the fluorescent brightener combination is replaced by 0.24% of Tinopal 5 BM and 0.1% of Phorwite BHC, a stable liquid detergent having soil release promoting properties, enzymatic effectiveness, brightening action and detergency like that of the composition of Example 1, results. The liquid detergent is clear light blue and in the absence of any dye it would be of a light color, so that it can be desirably colored by use of other dyes, too. Instead of the brightener system mentioned, equivalent proportions of Tinopal RBS-200, Tinopal 4226 (CIBA-Geigy) or Phorwite RKH (Mobay Chemical Company) and mixtures thereof may be substituted. In all such cases the substantivity of the fluorescent brightener is improved due to the presence of the anionic detergent and despite the presence of the alkylbenzene sulfonate detergent the polymeric soil release promoting agent is not destabilized.

EXAMPLE 3

The formula of Example 1 is changed so that 3% of sodium linear tridecylbenzene sulfonate is present instead of the dodecylbenzene sulfonate. The product made is stable and clear after storage at elevated temperature, and the enzyme stabilities equal those for the product of Example 1. However, when 2.8% of TEA is also present in the formula the product is unstable, with the QCJ soil release polymer flocculating out after storage at 43° C. for one week.

EXAMPLE 4

The contents of the various experimental formulas of this invention given in Examples 1–3 are varied ±10% and ±25%, while keeping the proportions of the various materials within the ranges recited in the specification. In such formulations instead of employing the QCJ soil release polymer (aqueous solution), equivalent portions of (on a solids basis) QCF (Alkaril Chemicals CAS 9016-88-0) and water are substituted, with the QCF first being dissolved in the water. Also other enzymes, stabilizers, alcohols and colorants, as described in the specification, may be employed within the proportion ranges given. The detergents resulting are clear, stable and non-separating and possess good soil release promoting, cleaning and brightening properties, like those described in Examples 1–3. Such is also the case when the fluorescent dye, colorant and perfume are omitted from the formulas of this example, although their constributions to the product are lost. Similarly, when triethanolamine or ionizable salt is present in such formula beyond the limits given the product becomes less stable and less effective in promoting soil release during washing, and when the sodium formate is omitted the effects of the enzyme are lost after only a few days storage at the elevated test temperature, and the loss of the buffering effect of the formate results in ultimate clouding and destabilization of the product.

In other variations in this example the nonionic detergent is Neodol 23-6.5 or a mixture of equal parts of Neodol 23-6.5 and Neodol 25-7, with the same total proportion being employed, and a stable effective product results. Also, instead of the described anionic detergent others previously named may be substituted, and good results are obtainable. With such variations results like those previously reported in Examples 1–3 are obtainable in both test washing machines and household and commercial washing machines, which are either top loading or side loading. Such is also the situation when pH adjustments are made with potassium hydroxide and when such adjustments, made with sodium hydroxide or potassium hydroxide, are to pH's of 7.4. 7.7 and 8.0, initially. Normally such pH adjustments will utilize less than 1% of sodium hydroxide and/or sulfuric acid solution, preferably less than 0.5% thereof and more preferably less than 0.2% thereof. In some instances the appropriate pH adjusting agent may be added as a formula constituent, in said proportion as is known to give the desired pH control (based on past experience with the formula) but it will still be highly preferred for it to be added before the enzyme. Similarly, while 40.5% and 93.2% concentrations of NaOH and $H_2SO_4$, respectively, are usually preferable, other concentrations thereof may be employed too.

From the working examples and the preceding description it is seen that the present invention is of a stable and attractive clear liquid detergent which contains various components that might have been expected to interfere with the stability of the final product. Yet, surprisingly, a stable product is obtainable in accordance with the invention. Such product has desirable soil release promoting, soil decomposing, fluorescent brightening (when the brightener is present) and detergent properties. Several of the components of the invented compositions exert dual effects therein. For example, the anionic detergent increases detergency and helps to make the substrates (laundry fibers) more substantive so that the fluorescent brighteners are more effective. The sodium formate, which is a stabilizer for enzymes, does not destabilize the soil release promoting agent, as would have been expected, and it stabilizes the copolymer and fluorescent brightener, as well as the enzymes. The various components of these liquid detergents coact to produce a surprisingly attractive, stable and effective clear detergent composition. Thus, it is seen that the present compositions represent an unpredictable advance in the art of making stable liquid detergent compositions that contain PET - POET copolymer and enzyme(s).

The invention has been described with respect to various illustrations and preferred embodiments thereof but is not to be limited to these because one of skill in the art, with the present specification before him, will be able to utilize substitutes and equivalents without departing from the invention.

What is claimed is:

1. A stable soil release promoting enzymatic liquid detergent comprising a detersive proportion of a nonionic detergent, a detergent supplementing and fluorescent brightener substantivity increasing proportion of an anionic sulf(on)ated synthetic organic detergent, a fluorescent brightening proportion of a fluorescent brightener, a soil release promoting proportion of a soil release promoting polymer of polyethylene terephthalate and polyoxyethylene terephthalate, a proportion of enyzme sufficient to enzymatically hydrolyze proteinaceous and/or amylaceous soilds on fabrics during washing thereof with an aqueous washing solution of such liquid detergent composition, a stabilizing and buffering proportion of a stabilizer for the enzymes(s), and an aqueous medium, in which, on storage, the pH is maintained in the range of 6.2 to 7.0, and the viscosity is maintained in the range of 50 to 150 centipoises, and in which there is present no triethanolamine and no more than a total of 10% of water soluble ionizable salt material, wherein the nonionic detergent is a condensation product of a mole of higher fatty alcohol of 10 to 20 carbon atoms and 3 to 20 moles of ethylene oxide, and the proportion of such nonionic detergent is within the range of 12 to 20%, the anionic sulf(on)ated detergent is a linear higher alkyl benzene sulfonate and the proportion thereof in in the range of 3 to 5%, the soil release promoting polymer is a polymer of polyethyelene terephthalate and polyoxyethylene terephthalate of a molecular weight in the range of 19,000 to 25,000 wherein the polyoxyethylene of the polyoxyethylene terephthalate is of a molecular weight in the range of about 3,000 to 4,000, and the molar ratio of ethylene terepyhthalate to polyoxyethylene terephthalate units is within the range of 5:2 to 5;1, and the proportion of such soil release promoting polymer is within the range of 0.5 to 1.5%, the enzyme includes proteolytic and amylolytic enzymes and the proportion of enzyme is within the range of 0.025 to 0.05%, the stabilizer for the enzyme is sodium formate and the proportion thereof is within the range of 2 to 4%, the fluorescent brightener is an aminostilbene brightener or an azolystilbene brightener or a mixture of fluorescent brighteners including such a brightener and the proportion thereof is within the range of 0.1 to 0.4%, and the aqueous medium is an aqueous alcoholic medium containing 5 to 15% of such medium of ethanol and 95 to 85% of water, which water is of a hardness, as $CaCO_3$, of less than 50 parts per million.

2. A liquid detergent according to claim 1, which is clear in appearance, of a pH in the range of 6.2 to 7.0 and of a viscosity in the range of 65 to 115 centipoises, wherein the nonionic-detergent is a condensation product of a mole of higher fatty alcohol of 12 to 15 carbon atoms and 6 to 11 moles of ethylene oxide, the alkyl of the higher alkylbenzene sulfonate is of 10 to 14 carbon atoms, the soil release promoting polymer is a polymer of polyethylene terephthalate and polyoxyethylene terephthalate of a molecular weight in the range of 19,000 to 25,000, wherein the polyoxyethylene of the polyoxyethylene terephthalate is of a molecular weight in the range of about 3,000 to 4,000 and the molar ratio of ethylene terephthalate to polyoxyethylene terephthalate units is within the range of 3:1 to 4:1, and the molar ratio of ethylene oxide to phthalic moiety therein is in the range of 20:1 to 30:1, and the water of the aqueous medium is softened water, of a hardness less than 20 p.p.m. $CaCO_3$.

3. A liquid detergent according to claim 2 wherein the proportions of nonionic detergent, higher alkylbenzene sulfonate, fluorescent brightener, soil release promoting polymer, enzymes, sodium formate, ethanol, and water are within the ranges of 15 to 17%, 3 to 4%, 0.1 to 0.3%, 0.8 to 1.2%, 0.025 to 0.05%, 2 to 4%, 4 to 6% and 65 to 75%, respectively.

4. A liquid detergent according to claim 3 which consists essentially of about 16% of a nonionic detergent which is a condensation product of a higher fatty alcohol of 12 to 15 carbon atoms and about 7 molar proportions of ethylene oxide, about 3.5% of sodium dodecylbenzene sulfonate, about 0.2% of aminostilbene fluorescent brightener, about 1% of soil release promoting PET - POET polymer of a weight average molecular weight of about 22,000, in which the polyoxyethylene of the polyoxyethylene terephthalate is of a molecular weight of about 3,400, the molar ratio of ethylene terephthalate to polyoxyethylene terephthalate units of the polymer is about 3:1 and the molar ratio of ethylene oxide to phthalic moiety therein is about 22:1, about 0.04% of mixed proteolytic and amylolytic enzyme preparation, about 3% of sodium formate, about 5% of ethanol, about 0.4% of perfume and about 70.1% of softened water, which is of a pH of about 6.2 and of a viscosity of about 90 centipoises at 25° C.

* * * * *